US008236395B2

(12) United States Patent
Nakano et al.

(10) Patent No.: US 8,236,395 B2
(45) Date of Patent: Aug. 7, 2012

(54) INKJET RECORDING MEDIUM

(75) Inventors: Ryoichi Nakano, Kanagawa (JP); Wataru Ono, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 188 days.

(21) Appl. No.: 12/874,238

(22) Filed: Sep. 2, 2010

(65) Prior Publication Data

US 2011/0059273 A1 Mar. 10, 2011

(30) Foreign Application Priority Data

Sep. 10, 2009 (JP) ..... 2009-209401

(51) Int. Cl.
*B41M 5/00* (2006.01)

(52) U.S. Cl. ..... 428/32.28; 428/32.34; 428/32.38

(58) Field of Classification Search ..... 428/32.28, 428/32.34, 32.38
See application file for complete search history.

(56) References Cited

U.S. PATENT DOCUMENTS

| | | | | |
|---|---|---|---|---|
| 6,403,198 | B1 * | 6/2002 | Urasaki | 428/32.28 |
| 2003/0118789 | A1 * | 6/2003 | Kasahara | 428/195 |
| 2004/0115369 | A1 * | 6/2004 | Yoshida et al. | 428/32.1 |

FOREIGN PATENT DOCUMENTS

| | | | |
|---|---|---|---|
| JP | 10-81064 | A | 3/1998 |
| JP | 3395882 | B2 | 4/2003 |
| JP | 3561864 | B2 | 9/2004 |
| JP | 2005-81645 | A | 3/2005 |
| JP | 4059356 | B2 | 3/2008 |

* cited by examiner

*Primary Examiner* — Betelhem Shewareged
(74) *Attorney, Agent, or Firm* — SOLARIS Intellectual Property Group, PLLC

(57) ABSTRACT

The inkjet recording medium herein provided has at least: a support; and an ink-receiving layer provided on the support, the ink-receiving layer comprising inorganic fine particles, two polyvinyl alcohols having a degree of saponification different from each other, and a low molecular weight polyvinyl alcohol having an average degree of polymerization of 2000 or less.

8 Claims, No Drawings

INKJET RECORDING MEDIUM

CROSS-REFERENCE TO RELATED APPLICATION

This application claims priority under 35 USC 119 from Japanese Patent Application No. 2009-209401 filed on Sep. 10, 2009, the disclosure of which is incorporated by reference herein.

BACKGROUND OF THE INVENTION

1. Field of Invention

The present invention relates to an inkjet recording medium.

2. Related Art

The inkjet recording method is a recording method which is widely used not only in offices, but also in homes in consideration of merits such as that recording can be carried out on various recording media, equipment is relatively inexpensive and compact, and superior quietness.

Since resolution of ink jet recording apparatus (printers) has increased, obtaining high quality recorded materials which are comparable to silver halide photographs has become possible. However, in order to take full advantage of printer capabilities and obtain recorded materials having silver halide photograph-like high quality and preservation properties, recording media that are designed for exclusive use with ink jet are required. Examples of required characteristics for ink jet recording media include ink absorbability, coloring property, storability, suitability to conveyance in printers, glossiness, and surface smoothness.

Ink jet recording media having a porous structure in an ink-receiving layer have been developed for improving the various characteristics described above. Examples thereof include ink jet recording media having a porous layer which includes inorganic fine particles and a hydrophilic binder, and has a high void ratio, provided on a support (for example, see Japanese Patent Nos. 3561864, 4059356 and 3395882).

Examples of the hydrophilic binder include polyvinyl alcohols. Among polyvinyl alcohols, in particular, polyvinyl alcohols having a high degree of polymerization are used in view of suppressing layer cracking. When an ink-receiving layer liquid is prepared using a polyvinyl alcohol having a high degree of polymerization, since the liquid may have a high viscosity, there may be cases in which the liquid cannot be easily handled, which may make it difficult to apply the liquid to the support. In particular, when an ink-receiving layer liquid is formed by adding a polyvinyl alcohol to a dispersion liquid of inorganic fine particles, the viscosity of the liquid may become higher and handling of the liquid may be difficult. In view of addressing this, for example, Japanese Patent Application Laid-Open (JP-A) No. 2005-81645 discloses a recording layer coating liquid in which two polyvinyl alcohols having different average degrees of polymerization and different degrees of saponification from each other are used for improving the handling property.

When the content ratio of the hydrophilic binder in the ink-receiving layer is decreased in order to attain a high void ratio, the ink-receiving layer may become fragile, and, in particular, when an inkjet recording medium having such an ink-receiving layer is stored under low humidity conditions, fine cracks may occur on the surface of the ink-receiving layer. In view of addressing this, for example, JP-A No. 10-81064 discloses an inkjet recording paper in which two polyvinyl alcohols having different degrees of polymerization from each other are used.

SUMMARY

The inkjet recording medium produced using a recording layer coating liquid described in JP-A No. 2005-81645 may have a problem in printing density, glossiness and layer forming property. The inkjet recording paper described in JP-A No. 10-81064 may also have a problem in printing density and film forming property.

The present invention is achieved in view of the above circumstances. The present invention provides an inkjet recording medium comprising: a support; an ink-receiving layer provided on the support, the ink-receiving layer comprising inorganic fine particles, two polyvinyl alcohols having a degree of saponification different from each other, and a low molecular weight polyvinyl alcohol having an average degree of polymerization of 2000 or less.

DETAILED DESCRIPTION

The inkjet recording medium herein provided has at least: a support; and an ink-receiving layer provided on the support. The ink-receiving layer has at least inorganic fine particles, two polyvinyl alcohols having a degree of saponification different from each other, and a low molecular weight polyvinyl alcohol having an average degree of polymerization of 2000 or less.

Polyvinyl Alcohols

The ink-receiving layer has two polyvinyl alcohols having a degree of saponification different from each other; and a low molecular weight polyvinyl alcohol having the polymerization degree of 2000 or less. The "polymerization degree" herein means an average degree of polymerization.

When two polyvinyl alcohols having a degree of saponification different from each other are included in a liquid for forming an ink-receiving layer (which, hereinafter, may be referred to as an "ink-receiving layer forming liquid"), the compatibility of these two polyvinyl alcohols may be insufficient in general, and the ink-receiving layer forming property may tend to be deteriorated.

The ink-receiving layer of the inkjet recording medium herein provided has, in addition to the two polyvinyl alcohols having a degree of saponification different from each other, a low molecular weight polyvinyl alcohol having a polymerization degree of 2000 or lower (which, hereinafter, may also be referred to as a "low molecular weight polyvinyl alcohol") is contained in the ink-receiving layer forming liquid. This configuration may facilitate to improve the ink-receiving layer forming property and also to improve the printing density and the glossiness of the inkjet recording medium.

The ink-receiving layer may further include, in addition to the two polyvinyl alcohols having a degree of saponification different from each other and the low molecular weight polyvinyl alcohol having a polymerization degree of 2000 or lower, one or more additional polyvinyl alcohols as long as the effect of the invention is not affected. The degree of saponification and the polymerization degree of the one or more additional polyvinyl alcohols are not specifically limited.

Two Polyvinyl Alcohols Having Different Degrees of Saponification from Each Other The degree of saponification of each polyvinyl alcohol of the two polyvinyl alcohols having a degree of saponification different from each other is not specifically limited. From the viewpoint of the viscosity stability of the ink-receiving layer forming liquid, the degree of saponification may be preferably from 95 mol % or more. From the viewpoint of the printing density, the degree of saponification may be preferably 90 mol % or less. In embodiments, one of the two polyvinyl alcohols having a degree of saponification different from each other may preferably have a degree of saponification of 95 mol % or more, and the other may preferably have a degree of saponification of 90 mol % or less.

The difference in the degrees of saponification of the two polyvinyl alcohols having a degree of saponification different from each other may be preferably from 5 mol % or more. When the difference in the degrees of saponification is 5 mol % or more, the compatibility of the two polyvinyl alcohols may become worse. Therefore, when the difference in the degrees of saponification is 5 mol % or more, the inclusion of the low molecular weight polyvinyl alcohol in the ink-receiving layer may more significantly exhibit its effect. The difference between the degrees of saponification of the two polyvinyl alcohols having a degree of saponification different from each other may be more preferably 8 mol % or more, and still more preferably 10 mol % or more.

In embodiments, when the two polyvinyl alcohols having different degrees of saponification from each other include a polyvinyl alcohol having a degree of saponification of 95 mol % or higher, the degree of saponification of a polyvinyl alcohol having a degree of saponification of 95 mol % or higher may be preferably 99 mol % or lower from the viewpoint of improving the ink absorbing property of the inkjet recording medium and suppression of curling of the inkjet recording medium.

In embodiments, when the two polyvinyl alcohols having different degrees of saponification from each other includes a polyvinyl alcohol having a degree of saponification of 90 mol % or lower), the degree of saponification of the polyvinyl alcohol having a degree of saponification of 90 mol % or lower may be preferably 70 mol % or higher. When the degree of saponification of the polyvinyl alcohol having a degree of saponification of 90 mol % or lower is 70 mol % or higher, the viscosity of the ink-receiving layer forming liquid may be less likely to be excessively high, and the coating stability may be improved.

The ratio of contents of the two polyvinyl alcohols having different degrees of saponification from each other (or the content ratio of each polyvinyl alcohol of the two polyvinyl alcohols having different degrees of saponification from each other relative to the total content of the two polyvinyl alcohols having different degrees of saponification from each other) is not specifically limited. In embodiments, a content of each of the two polyvinyl alcohols having a degree of saponification different from each other may be preferably 10% by mass or higher, and more preferably 15% by mass or higher, with respect to the total amount of the two polyvinyl alcohols having different degrees of saponification from each other and included in the ink-receiving layer. When the content of the polyvinyl alcohol that is contained in a smaller ratio than the other is 10% by mass or higher, the compatibility of the two polyvinyl alcohols may further be insufficient. Accordingly, when the content of the polyvinyl alcohol that is contained in a smaller ratio than the other is 10% by mass or higher, the inclusion of the low molecular weight polyvinyl alcohol may be more significantly exhibit its effect.

The polymerization degree of each polyvinyl alcohol of the two polyvinyl alcohols having a degree of saponification different from each other is not specifically limited. In embodiments, it may be preferable that at least one polyvinyl alcohol of the two polyvinyl alcohols having a degree of saponification different from each other is a high molecular weight polyvinyl alcohol having a polymerization degree of from 2500 to 4500. In embodiments, it may be more preferable that the two polyvinyl alcohols having a degree of saponification different from each other are respectively a high molecular weight polyvinyl alcohol having a polymerization degree of from 2500 to 4500.

When the polymerization degree of at least one polyvinyl alcohol of the two polyvinyl alcohols is 2500 or higher, cracking in the inkjet recording medium may be less likely to occur. When the polymerization degree of at least one polyvinyl alcohol of the two polyvinyl alcohols is 4500 or lower, the viscosity of the ink-receiving layer forming liquid may be less likely to be excessively high, and the ink-receiving layer forming liquid may become easy to handle.

In embodiments, a content of the at least one of the high molecular weight polyvinyl alcohols having a polymerization degree of from 2500 to 4500 may be preferably 50% by mass or higher, and more preferably 60% by mass or higher, with respect to a total content of polyvinyl alcohols included in the ink-receiving layer, in view of suppressing layer cracking.

When the two polyvinyl alcohols having a degree of saponification different from each other are respectively a high molecular weight polyvinyl alcohol having a polymerization degree of from 2500 to 4500, the content the at least one of the high molecular weight polyvinyl alcohols is a ratio of a total content of the two polyvinyl alcohols having a polymerization degree of from 2500 to 4500 relative to the total content of polyvinyl alcohols included in the ink-receiving layer.

Low Molecular Weight Polyvinyl Alcohol Having Polymerization Degree of 2000 or Lower The ink-receiving layer of the inkjet recording medium includes at least one low molecular weight polyvinyl alcohol having a polymerization degree of 2000 or lower (which may be herein referred to as a "low molecular weight polyvinyl alcohol"). In an embodiment, the ink-receiving layer may include two or more low molecular weight polyvinyl alcohols that have different polymerization degree and/or degrees of saponification from one another.

The polymerization degree of the low molecular weight polyvinyl alcohol is 2000 or lower, and in embodiments, it may be preferably from 1000 to 2000. When the polymerization degree of the low molecular weight polyvinyl alcohol exceeds 2000, the printing density and the glossiness may become lower. When the polymerization degree of the low molecular weight polyvinyl alcohol is 1000 or higher, cracking in the inkjet recording medium may be less likely to occur.

In embodiments, the degree of saponification of the low molecular weight polyvinyl alcohol may be preferably from 70 mol % to 99 mol %. The degree of saponification of 99 mol % or less may facilitate to improve the ink absorbing property of the inkjet recording medium and suppression of curling of the inkjet recording medium. The degree of saponification of 70 mol % or less may facilitate to suppress the viscosity of the ink-receiving layer forming liquid being excessively high, so that the coating stability may be improved.

In embodiments, the content of the low molecular weight polyvinyl alcohol may be preferably from 3% by mass to 33% by mass, and more preferably from 5% by mass to 30% by mass, with respect to the total amount of polyvinyl alcohols included in the ink-receiving layer, in view of improving the compatibility of the two polyvinyl alcohols having a degree of saponification different from each other. When two or more low molecular weight polyvinyl alcohols are included in the ink-receiving layer, the total content of the two or more low molecular weight polyvinyl alcohols may satisfy the above range.

In embodiments, any one or more of polyvinyl alcohols employed in the ink-receiving layer, which include the two polyvinyl alcohols having a degree of saponification different from each other and the low molecular weight polyvinyl alcohol and may optionally include other polyvinyl alcohol(s), may be a modified polyvinyl alcohol(s). Examples of the modified polyvinyl alcohol include acetoacetyl modified polyvinyl alcohol, cationic modified polyvinyl alcohol, anionic modified polyvinyl alcohol, silanol modified polyvinyl alcohol, and polyvinyl acetal modified polyvinyl alcohol.

Examples of the polyvinyl alcohols include those described in JP-A Nos. 4-52786, 5-67432, 7-29479, 7-57553, 63-176173, 7-276787, 9-207425, 11-58941, 2000-135858, 2001-205924, 2001-287444, 62-278080, 9-39373, 2000-158801, 2001-213045, 2001-328345, 8-324105, and 11-348417, and Japanese Patent Nos. 2537827, 2502998, 3053231, 2604367 and 2750433.

In embodiments, the total content of polyvinyl alcohols in the ink-receiving layer may be preferably from 9% by mass to 40% by mass, and more preferably from 12% by mass to 33% by mass, relative to the total solid content of the ink-receiving layer from the viewpoints of suppressing lowering of the layer strength and layer cracking when drying due to the excessively small content of polyvinyl alcohols, and also from the viewpoint of suppressing lowering of the ink absorbing property caused by decrease of the void ratio of the ink-receiving layer due to the excessively large content of polyvinyl alcohols.

Water-Soluble Resin

The ink receiving layer may contain a water-soluble resin which is other than polyvinyl alcohol as long as the effect of the inkjet recording medium is not affected. Examples of the water-soluble resin include cellulose resins (such as methyl cellulose (MC), ethyl cellulose (EC), hydroxyethyl cellulose (HEC), carboxymethyl cellulose (CMC), hydroxypropyl cellulose (HPC), hydroxyethylmethyl cellulose and hydroxypropylmethyl cellulose), chitins, chitosans, starch, resins having an ether bond (such as polypropylene oxide (PPO), polyethylene glycol (PEG) and polyvinyl ether (PVE)) and resins having a carbamoyl group (for example, polyacrylamide (PAAM), polyvinylpyrrolidone (PVP) and hydrazide polyacrylate). Examples thereof further include polyacrylates, maleic acid resins, alginate and gelatins, which respectively have a carboxyl group as a dissociable group.

Examples of the water-soluble resin further include compounds shown in paragraphs 0011 to 0014 of JP-A No. 11-165461.

The water-soluble resins may be used either singly or in combinations of two or more thereof.

When the polyvinyl alcohols and the water-soluble resin are used together, a total amount of polyvinyl alcohols with respect to the sum of the total amount of polyvinyl alcohols and that of the water-soluble resin may be preferably 50 mass % or more, and more preferably 70 mass % or more.

Inorganic Fine Particles

The ink receiving layer contains inorganic fine particles. Examples of the inorganic fine particles include silica fine particles, colloidal silica, titanium dioxide, barium sulfate, calcium silicate, zeolite, kaolinite, halloysite, mica, talc, calcium carbonate, magnesium carbonate, calcium sulfate, pseudoboehmite, zinc oxide, zinc hydroxide, alumina, aluminum silicate, magnesium silicate, zirconium oxide, zirconium hydroxide, cerium oxide, lanthanum oxide, and yttrium oxide.

In embodiments, the ink receiving layer may further contain, in addition to the inorganic fine particles, organic fine particles. Examples of the organic fine particles include polymer fine particles obtained by emulsion polymerization, microemulsion polymerization, soap free polymerization, seed polymerization, dispersion polymerization, suspension polymerization or the like, and specific examples thereof include powders of polyethylene, polypropylene, polystyrene, polyacrylate, polyamide, a silicon resin, a phenolic resin, or a natural polymer, and polymer fine particles in the form of latex or emulsion.

Among the inorganic fine particles, silica fine particles, colloidal silica, alumina fine particles and pseudo boehmite are preferable from the viewpoint of forming an excellent porous structure. The fine particles may be used as they are primary particles or may be used in the state of forming secondary particles. Silica fine particles having an average primary particle of 20 nm or less, colloidal silica having an average primary particle of 30 nm or less, alumina fine particles having an average primary particle of 20 nm or less, and pseudo boehmite having an average radius of pores of from 2 nm to 15 nm are more preferable, and such silica fine particles, alumina fine particles and pseudo boehmite are particularly preferable.

Silica fine particles are generally roughly divided into wet method particles and dry method particles (vapor phase method particles) in terms of their production method. The mainstream of the wet method is the one including decomposing a silicate by an acid to generate active silica, appropriately polymerizing the active silica, and coagulating-and-settling the resultant to obtain hydrate silica. On the other hand, the mainstream of the vapor phase method is a flame hydrolysis method, which includes hydrolyzing silicon halide at high temperature under high pressure, and an are method, which includes heating quartz sand and cokes and reducing by are in an electric furnace to vaporize and oxidizing the vaporized product by air to obtain anhydrous silica. "Fumed silica" means anhydrous silica fine particles obtained by the vapor phase method. The fumed silica fine particles are particularly preferable as the silica fine particles used in the invention.

The fumed silica is different from the hydrate silica in, for example, the density of a silanol group on the surface and the presence/absence of voids, and exhibits natures different from those of hydrate silica, whereas the vapor phase silica is preferable to form a three-dimensional structure having a high void ratio. Although the reason therefor is not clarified, it is estimated as follows. Namely, it is inferred that the density of a silanol group on the surface of the fine particles of hydrate silica is as many as 5 groups/nm$^2$ to 8 groups/nm$^2$, and therefore the silica fine particles are easily aggregated densely, whereas the density of a silanol group on the surface of fine particles of the fumed silica is 2 groups/nm$^2$ to 3 groups/nm$^2$ and therefore, silica fine particles become a rough soft flocculate, with the result that the fumed silica forms a structure having a high void ratio.

The fumed silica may provide the characteristics of improved ink absorbance and ink retaining efficiency to the inkjet recording medium because it has a particularly large specific surface area. Further, since the fumed silica has a low refractive index, transparency can be imparted to the ink receiving layer when it is dispersed until it has a proper particle diameter. Thus, the fumed silica may provide a high color density and sufficient coloring property to the inkjet recording medium. The transparency of the ink receiving layer can be important from the viewpoint of obtaining a high color density, favorable coloring property and favorable glossiness not only in applications which need transparency, such as OHPs, but also in applications of recording media such as photo-gloss paper.

The average primary particle diameter of the fumed silica is 30 nm or less, preferably 20 nm or less, particularly preferably 10 nm or less and most preferably 3 nm to 10 nm. Since the fumed silica particles are easily stuck to each other by hydrogen bonding due to a silanol group, the fumed silica can form a structure having a large void ratio when the average primary particle diameter is 30 nm or less, whereby the ink absorbance of the recording medium of the invention may be efficiently improved.

When the other fine particles (the inorganic fine particles and the organic fine particles) are combined with the fumed silica, the content of the fumed silica with respect to all fine particles in the ink receiving layer is preferably 30 mass % or more, and more preferably 50 mass % or more.

Preferable examples of the other inorganic fine particles include alumina fine particles, alumina hydrate, and a mixture or a complex of these. Among these, an alumina hydrate is preferable because it well absorbs and fixes ink. Pseudo-boehmite ($Al_2O_3.nH_2O$) is particularly preferable. Alumina hydrate of any one of various states may be used. In embodiments, sol-like boehmite may be preferably used as a raw material in view of easily obtaining a smooth layer.

The average radius of pores in the porous structure of pseudo-boehmite may be preferably 1 nm to 30 nm, and more preferably 2 nm to 10 nm. The volume of the pores may be preferably 0.3 ml/g to 2.0 ml/g, and more preferably 0.5 ml/g to 1.5 ml/g. Here, the pore radius and the pore volume are measured by a nitrogen adsorbing/desorbing method and may be specifically measured using a gas desorbing analyzer (for example, trade name: "OMNISOAP 369", manufactured by Coulter Company).

Among the alumina fine particles, alumina fine particles formed by vapor phase method have a large specific surface area and may be hence preferable. The average primary particle diameter of the alumina particles formed by vapor phase method may be preferably 30 nm or less, and more preferably 20 nm or less.

The content of the inorganic fine particles in the ink-receiving layer is not specifically limited. The total solid content of the inorganic fine particles in the ink-receiving layer may be preferably 50% by mass or higher, and more preferably higher than 60% by mass. When the content of the inorganic fine particles is within this range, a favorable porous structure may be formed to result in an inkjet recording medium having a sufficient ink absorbing property. The "total solid content of the fine particles in the ink-receiving layer" is a content calculated based on the components which form the ink-receiving layer except for water.

The inorganic fine particles may be particles of single material, or may be particles of a mixture of two or more materials.

Ratio of Fine Particles to Water-Soluble Resin

The weight ratio by mass [PB ratio=x/y] of the amount "x" of the fine particles to the amount "y" of the water-soluble resin in the ink receiving layer largely affects the layer structure and the layer strength of the ink receiving layer. Specifically, when the weight ratio (PB ratio) is increased, the density and the strength tend to decrease though the void ratio, pore volume, and surface area (per unit mass) tend to increase.

The PB ratio (x/y) in the ink receiving layer is preferably 1.5 to 10 from the viewpoint of suppressing defects caused by excessively large PB ratio (such as a reduction in layer strength or a formation of cracks during drying) as well as suppressing defects caused by excessively small PB ratio (such as a reduction in ink absorbance which is caused by reduced void ratio due to occurrence of tendency of clogging of the voids by the resin).

Since there may be a case that pressure is applied to the inkjet recording medium when it passes through a carrying system, the ink receiving layer may be desired to have sufficient layer strength. The ink receiving layer may also be desired to have sufficient layer strength in view of suppressing cracking and/or removal of the ink-receiving layer when the inkjet recording medium is cut into sheets. Taking these into account, the PB ratio (x/y) is preferably 5 or less. Further, the PB ratio is preferably 2 or more in view of ensuring high speed ink absorbance.

For example, a translucent porous film having an average pore diameter of 25 nm or less, a void ratio of 50% to 80%, a pore specific volume of 0.5 ml/g or more and a specific surface area of 100 $m^2/g$ or more may be formed with ease by: coating, onto a support, a coating liquid which is obtained by completely dispersing, in an aqueous solution, the fumed silica fine particles having an average primary particle diameter of 20 nm or less and the water-soluble resin at a P/B ratio (x/y) of from 2 to 5; and drying the coating liquid, whereby a three-dimensional network structure in which secondary particles of the silica fine particles form network chain units is formed.

Crosslinking Agent

The ink receiving layer may contain a crosslinking agent. More specifically, in embodiments, the ink receiving layer may be preferably a porous layer formed by curing, which is caused by a crosslinking reaction caused by the crosslinking agent at between the molecules of the polyvinyl alcohols and a water-soluble resin which is used if necessary.

Preferable examples of the crosslinking agent include a boron compound. Specific examples of the boron compound include borax, boric acid, borates (such as orthoborates, $InBO_3$, $ScBO_3$, $YBO_3$, $aBO_3$, $Mg_3(BO_3)_2$, and $CO_3(BO_3)_2$, diborates (such as $Mg_2B_2O_5$ and $CO_2B_2O_5$), methaborates ($LiBO_2$, $Ca(BO_2)_2$, $NaBO_2$ and $KBO_2$), tetraborates (such as $Na_2B_4O_7.10H_2O$) and pentaborates (such as $KB_5O_8.4H_2O$, $Ca_2B_6O_{11}.7H_2O$, and $CsB_5O_5$). Among These compounds, borax, boric acid, and borates are preferable and, boric acid is particularly preferable in the point that these compounds can cause a crosslinking reaction rapidly.

Examples of the crosslinking agent further include: aldehyde compounds such as formaldehyde, glyoxal and glutaraldehyde; ketone compounds such as diacetyl and cyclopentanedione; active halogen compounds such as bis(2-chloroethylurea)-2-hydroxy-4,6-dichloro-1,3,5-triazine and 2,4-dichloro-6-S-triazine sodium salt; active vinyl compounds such as divinylsulfonic acid, 1,3-vinylsulfonyl-2-propanol, N,N'-ethylenebis(vinylsulfonylacetamide), 1,3,5-triacryloyl-hexahydro-S-triazine; N-methylol compounds such as dimethylolurea and methylol dimethylhydantoin, melamine resins (for example, methylolmelamine and alkylated methylol melamine); epoxy resins;

isocyanate compounds such as 1,6-hexamethylenediisocyanate; aziridine compounds described in the specification of U.S. Pat. Nos. 3,017,280 and 2,983,611; carboxylmide compounds described in the specification of U.S. Pat. No. 3,100,704; epoxy compounds such as glycerol triglycidyl ether; ethyleneimino compounds such as 1,6-hexamethylene-N,N'-bisethyleneurea; halogenated carboxyaldehyde compounds such as mucochloric acid and mucophenoxychloric acid; dioxane compounds such as 2,3-dihydroxydioxane; metal-containing compounds such as titanium lactate, aluminum sulfate, chrome alum, potassium alum, zirconium acetate and chromium acetate; polyamine compounds such as tetraethylenepentamine; and hydrazide compounds such as dihydrazide adipate; and low-molecular materials or polymers having two or more oxazoline groups.

The crosslinking agents may be used either singly or in combinations of two or more.

In embodiments, the crosslinking and curing may be preferably carried out by: adding, to a basic liquid having a pH of 8 or more and/or a coating liquid (hereinafter also referred to as a "coating liquid A") that contains the inorganic fine particles, water-soluble resins (including the polyvinyl alcohols) and the like, a crosslinking agent to form the ink-receiving layer; and applying, either (1) at the same time when the above first liquid is applied to form a coating layer or (2) during the course of drying the coating layer formed by applying the first liquid and before the coating layer exhibits falling-drying rate, the basic liquid to the coating layer.

The amount of the crosslinking agent to be used is preferably 1 mass % to 50 mass %, and more preferably 5 mass % to 40 mass % based on the content of the water-soluble resin.

Mordant

The ink-receiving layer may preferably further contain a mordant in view of improving the water resistance of a formed image and a resistance to bleeding over time. Examples of the mordant include an organic mordant such as cationic polymers (cationic mordants) and an inorganic mordant. When the mordant is present in the ink-receiving layer, the mordant may interact with a liquid ink containing an anionic dye as a colorant to stabilize the colorant, whereby the water resistance and the bleeding over time can be further improved. The organic mordant and the inorganic mordant may be respectively used either singly or in combination of two or more. In embodiments, both of the organic mordant and the inorganic mordant may be used in combination.

Polymer mordants having, as a cationic functional group, a primary- to tertiary-amino group or a quaternary ammonium salt group is generally used. In embodiments, a cationic non-polymer mordant may also be used.

Examples of the polymer mordant include a homopolymer of a mordant monomer (namely, a monomer having a primary- to tertiary-amino group or its salt or a monomer having a quaternary ammonium salt group) or a copolymer or condensed polymer of the mordant monomer and other monomers (hereinafter referred to as "non-mordant monomer"). These polymer mordants may be used in any form of a water-soluble polymer or water-soluble latex particles. Specific examples of the polymer mordant include a poly(vinyl pyridine) salt, polyaklylaminoethyl acrylate, polyaklylaminoethyl methacrylate, poly(vinyl imidazole), polyethyleneimine, polybiguanide, polyguanide, polyallylamine and derivatives thereof, cationic polyurethane, and polydiallyldimethyl ammonium chloride.

Examples of the inorganic mordant include polyvalent water-soluble metal salts and hydrophobic metal salt compounds, and polyvalent water-soluble metal salts may be preferable. Specific examples of the inorganic mordant include salts or complexes of metals selected from magnesium, aluminum, calcium, scandium, titanium, vanadium, manganese, iron, nickel, copper, zinc, gallium, germanium, strontium, yttrium, zirconium, molybdenum, indium, barium, lanthanum, cerium, praseodymium, neodymium, samarium, europium, gadolinium, dysprosium, erbium, ytterbium, hafnium, tungsten and bismuth. Specific examples thereof further include a compound shown in paragraph 0058 of JP-A No. 2005-81645.

Among these inorganic mordants, aluminum-containing compounds, titanium-containing compounds, zirconium-containing compounds and compounds (salts or complexes) of metals of the IIIB group in the periodic chart are preferable.

The amount of the mordant to be added in the ink-receiving layer may be preferably 0.01 $g/m^2$ to 5 $g/m^2$, and may be more preferably 0.1 $g/m^2$ to 3 $g/m^2$. The coating liquid may be preferably prepared to have the content of the mordant within such ranges.

Other Components

The ink-receiving layer or the coating liquid for forming the ink-receiving layer may further contain, besides the essential components thereof, various known additives such as an ultraviolet ray absorber, an antioxidant, a fluorescent a whitening agent, a monomer, a polymerization initiator, a polymerization suppressor, a bleeding preventing agent, an antiseptic, a viscosity stabilizer, an antifoaming agent, a surfactant, an antistatic agent, a matt agent, a curling preventing agent or a water preventing agent according to the need.

The ink-receiving layer of the invention may contain an acid. The resistance to yellowing of the white portion of the recording medium can be improved by adjusting the surface pH of the ink-receiving layer to 3 to 8, preferably 4 to 6.0, by the addition of the acid. The surface pH may be determined according to "A" method (coating method) of measuring surface PH specified by the Japanese Technical Association of the Pulp and Paper Industry (J.TAPPI). The surface pH can be measured, for example, with a pH-measuring set for determining paper surface pH which complies with "A" method (trade name: MODEL MPC, manufactured by KYORITSU CHEMICAL-CHECK Lab., Corp.).

Specific examples of the acid include formic acid, acetic acid, glycolic acid, oxalic acid, propionic acid, malonic acid, succinic acid, adipic acid, maleic acid, malic acid, tartric acid, citric acid, benzoic acid, phthalic acid, isophthalic acid, glutaric acid, gluconic acid, lactic acid, aspartic acid, glutamic acid, salicylic acid, salicylic acid metal salts (salt of Zn, Al, Ca, Mg, or the like), methanesulfonic acid, itaconic acid, benzenesulfonic acid, toluenesulfonic acid, trifluofomethanesulfonic acid, styrenesulfonic acid, trifluoroacetic acid, barbituric acid, acrylic acid, methacrylic acid, cinnamic acid, 4-hydroxybenzoic acid, aminobenzoic acid, naphthalenedisulfonic acid, hydroxybenzenesulfonic acid, toluenesulfinic acid, benzenesulfinic acid, sufanilic acid, sulfamic acid, β-resorcinic acid, β-resorcinic acid, γ-resorcinic acid, gallic acid, fluoroglycine, sulfosalicyclic acid, ascorbic acid, erythorbic acid, bisphenolic acid, hydrochloric acid, nitric acid, sulfuric acid, phosphoric acid, polyphosphoric acid, boric acid, and boronic acid. The amount of the acid added may suitably determined such that the surface pH of the ink-receiving layer becomes 3 to 8.

The acid may be used in the form of a metal salt (such as a salt of sodium, potassium, calcium, cesium, zinc, copper, iron, aluminium, zirconium, lanthanum, yttrium, magnesium, strontium, cerium, or the like), or in the form of an amine salt (such as a salt of ammonia, triethylamine, tributylamine, piperazine, 2-methylpiperazine, polyallylamine, or the like).

The ink-receiving layer according to the invention preferably contains an additive for improving storage stability such as an ultraviolet absorber, an antioxidant, or an anti-bleeding agent.

Examples of the ultraviolet absorber, antioxidant, and anti-bleeding agent usable in the invention include alkylated phenol compounds (including hindered phenolcompounds), alkylthiomethylphenol compounds, hydroquinone compounds, alkylated hydroquinone compounds, tocopherol compounds, thiodiphenylether compounds, compounds having two or more thioether bonds, bisphenol compounds, O—-, N- and S-benzyl compounds, hydroxybenzyl compounds, triazine compounds, phosphonate compounds, acylaminophenol compounds, ester compounds, amide compounds, ascorbic acid, amine-based antioxidants, 2-(2-hydroxyphenyl)benzotriazole compounds, 2-hydroxy benzophenone compounds, acrylates, water-soluble or hydrophobic metal salts, organic metal compounds, metal complexes, hindered amine compounds (including TEMPO compounds), 2-(2-hydroxyphenyl)1,3,5-triazine compounds, metal deactivators, phosphite compounds, phosphonite compounds, hydroxylamine compounds, nitrone compounds, peroxide scavengers, polyamide stabilizers, polyether compounds, basic auxiliary stabilizers, nucleating agents, benzofuranone compounds, indolinone compounds, phosphine compounds, polyamine compounds, thiourea compounds, urea compounds, hydrazide compounds, amidine compounds, saccharide compounds, hydroxybenzoic acid compounds, dihydroxybenzoic acid compounds, trihydroxybenzoic acid compounds, and sulfoxide compounds.

The ink-receiving layer preferably contains at least one compound selected from the group consisting of alkylated phenol compounds, compounds having a thioether bond, bisphenol compounds, ascorbic acid, amine antioxidants, water-soluble or hydrophobic metal salts, organic metal compounds, metal complexes, hindered amine compounds, polyamine compounds, thiourea compounds, hydrazide compounds, hydroxybenzoic acid compounds, dihydroxybenzoic acid compounds, trihydroxybenzoic acid compounds and sulfoxide compounds.

Such other components may be used either singly or in combination of two or more. These other components may be added, to the coating liquid for forming the ink receiving layer, in the form of water-soluble state, polymer dispersion, emulsion, or oil droplets. In embodiments, these other components may be contained a microcapsule to be added to the coating liquid. The content of these other components in the ink receiving layer is preferably 0.01 $g/m^2$ to 10 $g/m^2$.

The surface of the inorganic fine particles may be treated with a silane coupling agent with the intention of improving the dispersibility of the inorganic fine particles. Preferable examples of the silane coupling agent include those having an organic functional group (for example, a vinyl group, amino group, epoxy group, mercapto group, chloro group, alkyl group, phenyl group or ester group) in addition to a portion working for coupling treatment.

The ink-receiving layer coating liquid preferably contains a surfactant. Preferable examples of the surfactant include a cationic surfactant, a nonionic surfactant, an amphoteric surfactant, a fluorine surfactant and a silicone surfactant.

Examples of the nonionic surfactant include polyoxyalkylene alkyl ether and polyoxyalkylene alkylphenyl ethers (e.g., diethylene glycol monoethyl ether, diethylene glycol diethyl ether, polyoxyethylene lauryl ether, polyoxyethylene stearyl ether and polyoxyethylene nonylphenyl ether), oxyethylene/oxypropylene block copolymer, sorbitan fatty acid esters (e.g., sorbitan monolaurate, sorbitan monooleate and sorbitan trioleate), polyoxyethylenesorbitan fatty acid esters (e.g., polyoxyethylenesorbitan monolaurate, polyoxyethylenesorbitan monooleate and polyoxyethylenesorbitan trioleate), polyoxyethylenesorbitol fatty acid esters (e.g., polyoxyethylene sorbitol tetraoleate), glycerin fatty acid esters (e.g., glycerol monooleate), polyoxyethyleneglycerin fatty acid esters (e.g., polyoxyethyleneglycerin monostearate and polyoxyethyleneglycerin monooleate), polyoxyethylene fatty acid esters (polyethyleneglycol monolaurate and polyethylene glycol monooleate), polyoxyethylenealkylamine and acetylene glycols (e.g., 2,4,7,9-tetramethyl-5-decyne-4,7-diol and ethylene oxide adduct or propylene oxide adduct of the diol). Polyoxyalkylene alkyl ethers are preferable. The nonionic surfactant may be contained singly or in combination of two or more thereof in the ink-receiving layer coating liquid.

Examples of the amphoteric surfactant include an amino acid surfactant, a carboxyammonium betaine surfactant, a sulfoneammonium betaine surfactant, an ammonium sulfate ester betaine surfactant and an imidazolium betaine surfactant. Preferable examples thereof include those described in U.S. Pat. No. 3,843,368 and JP-A Nos. 59-49535, 63-236546, 5-303205, 8-262742, 10-282619 and 2000-351269 and Japanese Patent Nos. 2514194 and 2514194. Among these amphoteric surfactants, an amino acid surfactant amphoteric surfactant, a carboxyammonium betaine surfactant, and a sulfoneammonium betaine surfactant are preferable. The amphoteric surfactant may be contained singly or in combination of two or more thereof.

Examples of the fluorine surfactant include compounds obtained by modifying an intermediate having a perfluoroalkyl group by using methods such as electrolytic fluorination, telomerization and oligomerization. Examples of the fluorine surfactant include a perfluoroalkyl sulfonate, perfluoroalkyl carboxylate, perfluoroalkyl ethyleneoxide adduct, perfluoroalkyltrialkyl ammonium salt, perfluoroalkyl group-containing oligomer and perfluoroalkyl phosphate.

As the silicone surfactant, silicone oil modified using an organic group is preferable. The silicone surfactant may have a structure in which the side chain, both of the terminals or one terminal of a siloxane structure is (are) modified by an organic group. Examples of the organic group-modification include amino-modification, polyether-modification, epoxy-modification, carboxyl-modification, carbinol-modification, alkyl-modification, aralkyl-modification, phenol-modification and fluorine-modification.

The content of the surfactant in the ink-receiving layer coating liquid is preferably 0.001% to 2.0 mass %, and more preferably 0.01% to 1.0 mass %. When two or more ink-receiving layer coating liquids are employed to form the ink-receiving layer, the ink-receiving layer coating liquids preferably respectively contain the surfactant.

The ink-receiving layer preferably contains a high-boiling temperature organic solvent so as to suppress curling. The high-boiling temperature organic solvent is a water-soluble or hydrophobic organic compound having a boiling temperature of 150° C. or higher under atmospheric pressure. The organic compound may be liquid or solid at room temperature, and may be a low-molecular weight compound or a polymer.

Specific examples thereof include aromatic carboxylate esters (such as dibutyl phthalate, diphenyl phthalate, and phenyl benzoate), aliphatic carboxylate esters (such as dioctyl adipate, dibutyl sebacate, methyl stearate, dibutyl maleate, dibutyl fumarate, and triethyl acetylcitrate), phosphate esters (such as trioctyl phosphate and tricresyl phosphate), epoxy compounds (such as epoxidized soy bean oil and epoxidized fatty acid methyl esters), alcohols (such as stearyl alcohol, ethylene glycol, propylene glycol, diethylene glycol, triethylene glycol, glycerol, diethylene glycol monobutylether (DEGMBE), triethylene glycol monobutylether, glycerin monomethyether, 1,2,3-butanetriol, 1,2,4-butanetriol, 1,2,4-pentanetriol, 1,2,6-hexanetriol, thiodiglycol, triethanolamine, and polyethylene glycol), vegetable oils (such as soy bean oil and sunflower seed oil), and higher aliphatic carboxylic acids (such as linoleic acid and oleic acid).

Support

Examples of the support include a transparent support of a transparent material such as plastic and an opaque support of an opaque material such as paper. In embodiments, use of a transparent support or an opaque high-glossiness support may be preferable for making the most of the transparency of ink-receiving layer. In embodiments, a read-only optical disk such as CD-ROM or DVD-ROM, a write once optical disk such as CD-R or DVD-R, or rewritable optical disk may be as the support and may form an ink-receiving layer on the label face thereof.

Material which is transparent and can endure radiant heat when used on OHPs and a backlight display may be preferable as a material used for the transparent support. Examples of the material include polyesters such as polyethylene terephthalate (PET); polysulfone, polyphenylene oxide, polyimide, polycarbonate and polyamide. In embodiments, the polyesters may be preferable among them, and polyethylene terephthalate may be more preferable.

The thickness of the transparent support is not particularly limited. In embodiments, the thickness may be preferably from 50 μm to 200 μm in view of ease of use.

In embodiments, an opaque support having high glossiness whose surface on which the ink receiving layer is formed has a glossiness degree of 40% or more may be preferable. The glossiness degree is a value determined according to the method described in JIS P-8142 (paper and a paperboard 75 degree method for examining specular glossiness degree), the disclosure of which is incorporated by reference herein. Specific examples of such supports include the following supports.

Examples include paper supports having high glossiness such as art paper, coat paper, cast coat paper and baryta paper used for a support for a silver salt photography or the like; polyesters such as polyethylene terephthalate (PET), cellulose esters such as nitrocellulose, cellulose acetate and cellulose acetate butyrate, opaque high glossiness films which are constituted by incorporating white pigment or the like in plastic films such as polysulfone, polyphenylene oxide, polyimide, polycarbonate and polyamide (a surface calendar treatment may be performed); or, supports in which a coating layer made of polyolefin which either does or does not contain a white pigment is formed on the surface of the various paper supports, transparent supports or a high glossiness film containing white pigment or the like.

Examples thereof further include a white pigment-containing foam polyester film (for instance, a foam PET which contains the polyolefin fine particles, and contains voids formed by drawing out) and a resin coated paper to be used for a printing paper for silver halide salt photographic use.

The thickness of the opaque support is not particularly limited. In embodiments, a thickness of 50 μm to 300 μm may be preferable in view of ease of handling.

The surface of the support may be subjected to treatment such as corona discharge treatment, glow discharge treatment, flame treatment or ultraviolet radiation treatment in view of improving wetting and adhesion properties.

A base paper is used for paper support such as resin coated paper. The base paper is mainly made of wood pulp, and is made by using a synthetic pulp, such as polypropylene, in addition to the wood pulp if necessary, or a synthetic fiber such as nylon or polyester. LBKP, LBSP, NBKP, NBSP, LDP, NDP, LUKP and NUKP can be used as the wood pulp. It is preferable to use more LBKP, NBSP, LBSP, NDP and LDP which contain a lot of short fibers. The ratio of LBSP and/or LDP is preferable in the range between 10% by mass and 70% by mass.

A chemical pulp with few impurities (such as sulfate pulp and sulfite pulp) may be preferably used as the pulp, and a pulp in which whiteness is improved by bleaching, may be useful.

Sizing agents such as higher fatty acid and alkyl ketene dimer, white pigments such as calcium carbonate, talc and titanium oxide, paper reinforcing agents such as starch, polyacrylamide and polyvinyl alcohol, optical whitening agents, water retention agents such as polyethylene glycols, dispersants, and/or softening agents such as a quaternary ammonium may be appropriately contained in the base paper.

The freeness of pulp used for papermaking is preferably from 200 ml to 500 ml as stipulated in CSF. The sum of 24 mesh remainder portions and 42 mesh remainder portions as stipulated in JIS P-8207, the disclosure of which is incorporated by reference herein, is preferably from 30% by mass to 70% by mass. 4 mesh remainder portion may be preferably 20% by mass.

The basis weight of the base paper may be preferably from 30 g to 250 g, and particularly preferably from 50 g to 200 g. The thickness of the base paper may be preferably 40 μm to 250 μm. In embodiments, high smoothness may be imparted to the base paper by calendar treatment at the making paper step or after paper making. The density of the base paper as stipulated in JIS P-8118, the disclosure of which is incorporated by reference herein, is generally 0.7 g/m$^2$ to 1.2 g/m$^2$. In addition, the strength of the base paper may be preferably from 20 g to 200 g under the conditions of JIS P-8143, the disclosure of which is incorporated by reference herein.

In embodiments, a surface size agent may be coated on the surface of the base paper, and examples of the size agent which is similar to the size agent which can be added to the base paper. In embodiments, the pH of the base paper may be from 5 to 9 when measured by a hot water extraction method provided by JIS P-8113, the disclosure of which is incorporated by reference herein.

When the both front and back surfaces of the base paper is coated with polyethylene, examples of the polyethylenes used in general include low density polyethylene (LDPE) and/or high density polyethylene (HDPE), although others such as LLDPE and polypropylene may be also used in part.

In embodiments, the polyethylene layer on the side on which the ink receiving layer is formed may be preferably that having rutile type or anatase type titanium oxide, an optical whitening agent or ultramarine blue pigment so that the degree of opaqueness, whiteness and hue are improved, as is widely performed for printing papers for photographs. Herein, the content of titanium oxide may be preferably from about 3% by mass to 20% by mass, and more preferably from 4% by mass to 13% by mass to polyethylene. The thickness of the polyethylene layer is not limited to a particular thickness, although in embodiments, it may be preferably from 10 μm to 50 μm. In embodiments, an undercoat layer may be formed on the polyethylene layer in view of giving adhesion of the ink receiving layer. Aqueous polyester, gelatin, and/or PVA may be preferably used for forming the undercoat layer. In embodiments, the thickness of the undercoat layer may be preferably from 0.01 μm to 5 μm.

In embodiments, the polyethylene coated paper sheet may be a glossy paper, or may be one formed by providing a matte surface or silk finish surface by applying an embossing treatment, like that performed in forming usual photographic printing paper sheets, when polyethylene is coated on the surface of the base paper sheet by melt-extrusion.

In embodiments, the support may have a back coat layer, and examples of components of the back coat layer include white pigments, water soluble binders and other components.

Examples of the white pigment contained in the back coat layer include inorganic white pigments such as calcium carbonate light, calcium carbonate heavy, kaolin, talc, calcium sulfate, barium sulfate, titanium dioxide, zinc oxide, zinc sulfide, zinc carbonate, satin white, aluminum silicate, diatomaceous earth, calcium silicate, magnesium silicate, synthetic amorphous silica, colloidal silica, colloidal alumina, pseudo-boehmite, aluminum hydroxide, alumina, lithopone, zeolite, hydrated halloysite, magnesium carbonate and magnesium hydroxide; and organic pigments such as styrene based plastic pigments, acrylic based plastic pigments, polyethylene, microcapsules, urea resin and melamine resin.

Examples of the aqueous binders used for the back coat layer include water soluble polymers such as styrene/maleic acid copolymer, styrene/acrylate copolymer, polyvinyl alcohol, silanol modified polyvinyl alcohol, starch, cationic starch, casein, gelatin, carboxymethyl cellulose, hydroxyethyl cellulose and polyvinyl pyrrolidone; and water dispersible polymers such as styrene-butadiene latex and acrylic emulsion.

Examples of other components which may be contained in the back coat layer include defoaming agents, foaming suppressing agents, dyes, fluorescent whitening agents, preservatives and water-proofing agents.

Production of Inkjet Recording Medium

In embodiments, the inkjet recording medium may be formed a process including forming the ink-receiving layer by applying, over (on or above) the support, the ink-receiving layer forming liquid which contains at least: the inorganic fine particles; the two polyvinyl alcohols having a degree of saponification different from each other; and the low molecular weight polyvinyl alcohol having the polymerization degree of 2000 or less.

In embodiments, the ink-receiving layer may be formed by Wet-On-Wet method, which includes applying the ink-receiving layer forming liquid over the support, and by applying thereon a basic solution having a pH of 8 or more and containing at least a mordant, either (1) simultaneously with the application of the ink-receiving layer forming liquid or (2) before the applied liquid (layer) exhibits a falling drying rate during drying of the applied liquid, so that the applied liquid is cured by crosslinking. Presence of such a crosslinked hardened ink-receiving layer may be preferable from the viewpoints of improving the ink-absorbing capacity and suppressing cracking resistance of the ink-receiving layer.

The coating liquid for forming the ink receiving layer can be formed by, for example, a method including: adding the fumed silica fine particles and the dispersant to water (the concentration of the silica fine particles may be, for example, from 10 mass % to 20 mass %); pre-dispersing the mixture using a high-speed rotational wet method colloid mil (such as CLEARMIX (trade name, manufactured by M Technique)) at a high rotation condition of, for example, 10,000 rpm (preferably in a range of from 5,000 to 20,000 rpm) for a period of, for example, 20 minutes (preferably from 10 to 30 minutes); adding the crosslinking agent (such as the boric compound) and an aqueous PVA solution (the amount of PVA in which is adjusted to achieve, for example, one-third of that of the fumed silica fine particles) and dispersing, at the same condition as the pre-dispersing, the obtained mixture. The resulting coating liquid has a uniform sol state. A porous ink-receiving layer having a three-dimensional network structure can be obtained by applying this coating liquid to a support by a coating method explained below and then drying.

In preferable embodiments, the polyvinyl alcohol having the low polymerization degree is firstly added to the dispersion system and dispersed, and then the polyvinyl alcohols having the high polymerization degree are added to the dispersion system and dispersed. The temperature at which the polyvinyl alcohols are added may be preferably in a range of from 10° C. to 50° C. in view of making the viscosity of the ink receiving layer be lower.

The aqueous dispersion including the fumed silica and the dispersant may be prepared by preparing a fumed silica dispersion liquid and then adding the thus obtained aqueous dispersion liquid to the aqueous solution of the dispersant, adding the aqueous solution of the dispersant to the aqueous dispersion liquid, or mixing these at the same time. In embodiments, instead of using the aqueous dispersion liquid of the vapor phase silica, the vapor phase silica in a powder state may be added to the aqueous solution of the dispersant.

After mixing the vapor phase silica and the dispersant, the thus obtained mixture liquid may be treated by using a disperser to form fine particles, whereby an aqueous dispersion liquid of particles having an average particle size of from 50 nm to 300 nm may be obtained. Conventionally known dispersing machines such as a high-speed dispersing machine, a medium stirring dispersing machine (such as a ball mill or a sand mill), an ultrasonic dispersing machine, a colloid mill dispersing machine, and high-pressure dispersing machine may be used as the dispersing machine used for obtaining the aqueous dispersion. Among these dispersing machines, a medium stirring dispersing machine, a colloid mill dispersing machine, and high-pressure dispersing machine are preferable in view of efficiently dispersing pilled fine particles to be formed.

Water, an organic solvent, or a mixture solvent of these solvents may be used as a solvent in each process. Examples of the organic solvent used for this coating operation include alcohols such as methanol, ethanol, n-propanol, i-propanol and methoxypropanol, ketones such as acetone and methyl ethyl ketone, tetrahydrofuran, acetonitrile, ethyl acetate, and toluene.

A cationic polymer may be used as the dispersant. Examples of the cationic polymer include those given as the examples of the mordant. A silane coupling agent may also be preferably used as the dispersant.

The amount of the dispersant to be added may be from 0.1 mass % to 30 mass %, and more preferably 1 mass % to 10 mass %, based on the content of the fine particles.

Examples of the method of applying the coating liquid include conventionally-known methods using an extrusion die coater, an air doctor coater, a blade coater, a rod coater, a knife coater, a squeeze coater, a reverse roll coater or a bar coater.

EXAMPLES

Hereinafter, the invention will be described in more detail with reference to examples, but the invention is not limited to the examples. Further, "parts" and "%" are expressed in terms of mass, unless otherwise specified.

Example 1

Preparation of Support 50 parts of acacia LBKP and 50 parts of aspen LBKP were beaten to a Canadian freeness of 300 ml in a disk refiner, to give a pulp slurry.

To the pulp slurry, 1.3% of a cationic starch (trade name: CAT0304L, manufactured by Japan NSC), 0.15% of an anionic polyacrylamide (trade name: POLYACRON ST-13, manufactured by Seiko Chemicals, Co., Ltd.), 0.29% of an alkylketene dimer (trade name: SIZEPINE K, manufactured by Arakawa Chemical Industries, Ltd.), 0.29% of epoxidated amide behenate, and 0.32% of polyamide polyamine epichlorohydrin (trade name: ARAFIX 100, manufactured by Arakawa Chemical Industries, Ltd.) were added to the pulp slurry and then, 0.12% of an antifoaming agent was further added thereto. Herein, the amounts of the added components are expressed with respect to the amount of the pulp slurry.

The thus-prepared pulp slurry was then made into paper using a Fourdrinier paper machine, and subjected to drying in which a felt surface of a web is pressed against a drum dryer cylinder via a dryer canvas with the dryer canvas tension adjusted to 1.6 kg/cm. After drying, both surfaces of the resultant were coated with polyvinyl alcohol (trade name: KL-118, manufactured by Kuraray Co., Ltd.) at rate of 1 g/m$^2$ by using a size press and, the resultant was further subjected to drying and calender processing to form a base paper (base material). The basis weight of the base paper was 157 g/m$^2$, and the thickness of the base paper was 157 μm.

After subjecting the wire surface (rear surface) of the base material to corona electrical discharge treatment, a blend of high- and low-density polyethylene resins at a ratio of 80%/20% was melt-extruded to a dry weight of 20 g/m$^2$ on the wire-faced surface (rear face) of the base material by using a melt extruder at a temperature of 320° C., to give a mat-surfaced thermoplastic layer (hereinafter, the thermoplastic resin face will be referred to as "rear face"). The thermoplastic resin layer on the rear face side was further subjected to corona discharge treatment and then, as an antistatic agent, a dispersion containing aluminum oxide (trade name: ALUMINA SOL 100, manufactured by Nissan Chemical Industries Co., Ltd.) and silicon dioxide (trade name: SNOWTEX O, manufactured by Nissan Chemical Industries Co., Ltd.) dispersed at a rate of 1:2 by weight in water was coated thereon to a dry weight of 0.2 g/m$^2$. Then, the surface was subjected to corona discharge treatment, and a polyethylene having a density of 0.93 g/m$^2$ containing 10 wt % titanium oxide was coated thereon to a dry weight of 24 g/m$^2$ at 320° C. by using a melt extruder to provide a support.

Preparation of Ink-Receiving Layer-Forming Liquid A

Silica fine particles were added to a liquid containing dimethyldiallyl ammonium chloride polymer (trade name: SHALLOL DC902P, manufactured by Dai-Ichi Kogyo Seiyaku) in ion-exchange water, and ZIRCOSOL ZA-30 (trade name, manufactured by Daiichi Kigenso Kagaku Kogyo Co., Ltd.) was further added thereto. The resulting slurry was dispersed in ULTIMIZER (trade name, manufactured by Sugino Machine Ltd.) at 170 MPa, to give a silica dispersion A having the following formulation and containing particles having a median diameter (average particle diameter) of 120 nm.

Ion-exchange water, 7.5% boric acid solution, SC-505, polyvinyl alcohol solution, and SUPERFLEX 650-5 were then added to the silica dispersion A in this order, to give an ink-receiving layer-forming liquid A having the following formulation.

Formulation of Silica Dispersion A

| | |
|---|---|
| Fumed silica fine particles (trade name: AEROSIL 300SF75, manufactured by Nippon Aerosil Co., Ltd.) | 15.0 parts |
| Ion-exchange water | 82.9 parts |
| Dispersant (trade name: SHALLOL DC-902P, manufactured by Dai-ichi Kogyo Seiyaku Co., Ltd.) (51.5% solution)) | 1.3 parts |
| Mordant (zirconyl acetate, trade name: ZIRCOSOL ZA-30, manufactured by Daiichi Kigenso Kagaku Kogyo Co., Ltd.) (50% solution) | 0.81 parts |

Formulation of Ink-Receiving Layer-Forming Liquid A

| | |
|---|---|
| Silica dispersion A | 59.5 parts |
| Ion-exchange water | 7.8 parts |
| 7.5% Boric acid solution (crosslinking agent) | 4.4 parts |
| Dimethylamine epichlorohydrin polyalkylene polyamine polycondensate (50% solution) (trade name: SC-505, manufactured by Hymo Co., Ltd.) | 0.1 parts |
| Polyvinyl alcohol solution having the formulation shown below | 26.0 parts |
| Cationic modified polyurethane (trade name: SUPERFLEX 650, manufactured by Dai-ichi Kogyo Seiyaku Co., Ltd. (25% solution)) | 2.2 parts |

Formulation of Polyvinyl Alcohol Solution

| | |
|---|---|
| Polyvinyl alcohol (trade name: PVA-124, manufactured by Kuraray Co., Ltd., degree of saponification: 98.5 mol %, polymerization degree: 2400) | 1.39 parts |
| Polyvinyl alcohol (trade name: PVA-235, manufactured by Kuraray Co., Ltd., degree of saponification: 88.0 mol %, polymerization degree: 3500) | 4.18 parts |
| Polyvinyl alcohol (trade name: PVA-613, manufactured by Kuraray Co., Ltd., degree of saponification: 93.5 mol %, polymerization degree: 1300) | 1.39 parts |
| Polyoxyethylene lauryl ether (surfactant, trade name: EMULGEN 109P, manufactured by Kao Corp.) | 0.23 parts |
| Diethylene glycol monobutylether (trade name: BUTYCENOL 20P, manufactured by Kyowa Hakko Kogyo Co., Ltd.) | 2.12 parts |
| Water-soluble cellulose (trade name: HPC-SSL, manufactured by Nippon Soda Co., Ltd.) | 0.31 parts |
| Ion-exchange water | 90.38 parts |

Preparation of Inkjet-Recording Medium

The front face of the support was subjected to corona discharge treatment. The ink-receiving layer-forming liquid A and the following PAC 1 solution were in-line blended and coated thereon at coating amounts respectively of 183 g/m$^2$ and 11.4 g/m$^2$ by using an extrusion die coater. Then, the coated layer was dried in a hot air dryer at 80° C. (flow rate: 3 msec to 8 msec) to have a solid content of 20%. The coated layer showed a constant drying rate during the drying. The coated layer was then immersed in a basic solution (pH: 7.8) in the following composition for three seconds before it showed a falling drying rate, allowing deposition of the solution on the coated layer in an amount of 13 g/m$^2$, and dried at 65° C. for 10 minutes (hardening), to provide an inkjet-recording medium of Example 1 carrying an ink-receiving layer having a dry film thickness of 32 μm.

Formulation of PAC 1 Solution

| | |
|---|---|
| Aqueous polyaluminum chloride solution having a basicity of 83% (trade name: ALFINE 83, manufactured by Taimei Chemicals Co., Ltd. Co.) | 20 parts |
| Ion-exchange water | 80 parts |

Formulation of Basic Solution

| | |
|---|---|
| Boric acid | 0.6 parts |
| Ammonium carbonate (reagent grade, manufactured by Kanto Kagaku Co. Inc.) | 4.0 parts |

-continued

| | |
|---|---|
| Ion-exchange water | 89.4 parts |
| Polyoxyethylene lauryl ether (10% aqueous solution) (surfactant, trade name: EMULGEN 109P, manufactured by Kao Corp.) | 6.0 parts |

The inkjet-recording medium of Example 1 was subjected to the following evaluations. Results thereof are shown in the following Table 1.

Evaluation of Printing Density

An image was printed on the inkjet-recording medium with black ink using an inkjet printer (trade name: PM-G800, manufactured by Seiko Epson Corporation). The optical density of the printed sample was determined by using a densitometer (trade name: X-LITE, manufactured by X-Lite).

Evaluation Criteria:

A: Printing density is 2.4 or more.

B: Printing density is 2.2 or more but less than 2.4.

C: Printing density is less than 2.2.

Evaluation of Glossiness

The gloss of a surface of the surface of the ink receiving layer of the recording medium on which no image is recorded was measured at an incident angle of 60° and a light reception angle of 60° using a digital variable glossmeter, UGV-5D (trade name, manufactured by Suga Test Instruments Co., Ltd.; measurement pore: 8 mm). Magnification which was calculated from the measured value with respect to a standard value is shown in Table 1.

Evaluation of Film Forming Property 0.1 mL of water was dropped onto a surface of the surface of the ink receiving layer of the recording medium on which no image is recorded. The recording medium was dried by being left stand for 24 hours at room temperature. The surface of the ink receiving layer was visually observed, and the number of crack defects formed on the ink receiving layer was determined.

Evaluation Criteria:

A: no crack is observed.

B: Practically acceptable, although a slight crack is observed.

C: Practically problematic. Many cracks are observed.

Example 2

An inkjet recording medium of Example 2 was prepared and evaluated in the substantially similar manner to that in Example 1, except that PVA-105 (trade name, manufactured by Kuraray Co., Ltd., degree of saponification: 98.5 mol %, polymerization degree: 500) was used in the polyvinyl alcohol solution in place of the PVA-613 (described above). The results are shown in Table 1.

Example 3

An inkjet recording medium of Example 3 was prepared and evaluated in the substantially similar manner to that in Example 1, except that PVA-217 (trade name, manufactured by Kuraray Co., Ltd., degree of saponification: 88.0 mol %, polymerization degree: 1700) was used in the polyvinyl alcohol solution in place of the PVA-613 (described above). The results are shown in Table 1.

Example 4

An inkjet recording medium of Example 4 was prepared and evaluated in the substantially similar manner to that in Example 1, except that PVA-205 (trade name, manufactured by Kuraray Co., Ltd., degree of saponification: 88.0 mol %, polymerization degree: 500) was used in the polyvinyl alcohol solution in place of the PVA-613 (described above). The results are shown in Table 1.

Example 5

An inkjet recording medium of Example 5 was prepared and evaluated in the substantially similar manner to that in Example 1, except that the amounts of PVA-124, PVA-235, and PVA-613 were changed to 1.39 parts, 3.48 parts, and 2.09 parts respectively. The results are shown in Table 1.

Example 6

An inkjet recording medium of Example 6 was prepared and evaluated in the substantially similar manner to that in Example 1, except that the amounts of PVA-124, PVA-235, and PVA-613 were changed to 1.39 parts, 5.22 parts, and 0.35 parts respectively. The results are shown in Table 1.

Example 7

An inkjet recording medium of Example 7 was prepared and evaluated in the substantially similar manner to that in Example 1, except that PVA-245 (trade name, manufactured by Kuraray Co., Ltd., degree of saponification: 88.0 mol %, polymerization degree: 4500) was used in the polyvinyl alcohol solution in place of the PVA-235 (described above). The results are shown in Table 1.

Comparative Example 1

An inkjet recording medium of Comparative example 1 was prepared and evaluated in the substantially similar manner to that in Example 1, except that the formulation of the polyvinyl alcohol solution was changed to the following one. The results are shown in Table 1.

Formulation of Polyvinyl alcohol solution used in Comparative example 1

| | |
|---|---|
| Polyvinyl alcohol (trade name: PVA-124, manufactured by Kuraray Co., Ltd., degree of saponification: 98.5 mol %, polymerization degree: 2400) | 3.48 parts |
| Polyvinyl alcohol (trade name: PVA-235, manufactured by Kuraray Co., Ltd., degree of saponification: 88.0 mol %, polymerization degree: 3500) | 3.48 parts |
| Polyoxyethylene lauryl ether (surfactant, trade name: EMULGEN 109P, manufactured by Kao Corp.) | 0.23 parts |
| Diethylene glycol monobutylether (trade name: BUTYCENOL 20P, manufactured by Kyowa Hakko Kogyo Co., Ltd.) | 2.12 parts |
| Water-soluble cellulose (trade name: HPC-SSL, manufactured by Nippon Soda Co., Ltd.) | 0.31 parts |
| Ion-exchange water | 90.38 parts |

Comparative Example 2

An inkjet recording medium of Comparative example 2 was prepared and evaluated in the substantially similar manner to that in Comparative example 1, except that PVA-245 (trade name, manufactured by Kuraray Co., Ltd., degree of saponification: 88.0 mol %, polymerization degree: 4500) was used in the polyvinyl alcohol solution in place of the PVA-235 (described above). The results are shown in Table 1.

Comparative Example 3

An inkjet recording medium of Comparative example 3 was prepared and evaluated in the substantially similar manner to that in Comparative example 1, except that PVA-117 (trade name, manufactured by Kuraray Co., Ltd., degree of saponification: 98.5 mol %, polymerization degree: 1700) was used in the polyvinyl alcohol solution in place of the PVA-124 (described above). The results are shown in Table 1.

Comparative Example 4

An inkjet recording medium of Comparative example 4 was prepared and evaluated in the substantially similar manner to that in Comparative example 1, except that PVA-613 (trade name, manufactured by Kuraray Co., Ltd., degree of saponification: 93.5 mol %, polymerization degree: 1300) was used in the polyvinyl alcohol solution in place of the PVA-235 (described above). The results are shown in Table 1.

Comparative Example 5

An inkjet recording medium of Comparative example 5 was prepared and evaluated in the substantially similar manner to that in Comparative example 1, except that PVA-105 (trade name, manufactured by Kuraray Co., Ltd., degree of saponification: 98.5 mol %, polymerization degree: 500) was used in the polyvinyl alcohol solution in place of the PVA-235 (described above). The results are shown in Table 1.

Comparative Example 6

An inkjet recording medium of Comparative example 6 was prepared and evaluated in the substantially similar manner to that in Example 1, except that PVA-624 (trade name, manufactured by Kuraray Co., Ltd., degree of saponification: 95.5 mol %, polymerization degree: 2400) was used in the polyvinyl alcohol solution in place of the PVA-613 (described above). The results are shown in Table 1.

TABLE 1

| | Degree of saponification (mol %) | Polymerization degree | Mixing ratio (% by mass) of Polyvinyl Alcohols | | | | | | | | | | | | |
|---|---|---|---|---|---|---|---|---|---|---|---|---|---|---|---|
| | | | Examples | | | | | | | Comparative examples | | | | | |
| | | | 1 | 2 | 3 | 4 | 5 | 6 | 7 | 1 | 2 | 3 | 4 | 5 | 6 |
| PVA-105 | 98.5 | 500 | | 20 | | | | | | | | | | 50 | |
| PVA-117 | | 1700 | | | | | | | | | | 50 | | | |
| PVA-124 | | 2400 | 20 | 20 | 20 | 20 | 20 | 20 | 20 | 50 | 50 | | 50 | 50 | 20 |
| PVA-205 | 88.0 | 500 | | | | 20 | | | | | | | | | |
| PVA-217 | | 1700 | | | 20 | | | | | | | | | | |
| PVA-235 | | 3500 | 60 | 60 | 60 | 60 | 50 | 75 | | 50 | | 50 | | | 60 |
| PVA-245 | | 4500 | | | | | | | 60 | | 50 | | | | |
| PVA-613 | 93.5 | 1300 | 20 | | | | 30 | 5 | 20 | | | | 50 | | |
| PVA-624 | 95.5 | 2400 | | | | | | | | | | | | | 20 |
| Printing density | | | A | B | A | A | B | B | A | C | C | C | C | C | A |
| Glossiness | | | 1.8 | 1.8 | 1.8 | 1.6 | 1.4 | 1.4 | 1.8 | 1.0 | 0.9 | 1.0 | 1.2 | 1.8 | 1.1 |
| Film Forming Property | | | A | A | A | B | B | A | A | A | A | A | C | C | A |

The results shown in Table 1 indicate that the inkjet recording medium of Examples have high printing density, high glossiness, and favorable film forming property.

All publications, patent applications, and technical standards mentioned in this specification are herein incorporated by reference to the same extent as if such individual publication, patent application, or technical standard was specifically and individually indicated to be incorporated by reference. It will be obvious to those having skill in the art that many changes may be made in the above-described details of the preferred embodiments of the present invention. It is intended that the scope of the invention be defined by the following claims and their equivalents.

What is claimed is:

1. An inkjet recording medium comprising:

a support; and an ink-receiving layer provided on the support, the ink-receiving layer comprising inorganic fine particles, two polyvinyl alcohols having a degree of saponification different from each other, and a low molecular weight polyvinyl alcohol having an average degree of polymerization of 2000 or less.

2. The inkjet recording medium of claim 1, wherein at least one of the two polyvinyl alcohols having a degree of saponification different from each other has an average degree of polymerization of from 2500 to 4500.

3. The inkjet recording medium of claim 1, wherein the content of the low molecular weight polyvinyl alcohol with respect to a total amount of polyvinyl alcohols included in the ink-receiving layer is from 3% by mass to 33% by mass.

4. The inkjet recording medium of claim 1, wherein one of the two polyvinyl alcohols having a degree of saponification different from each other has a degree of saponification of 95 mol % or more, and the other has a degree of saponification of 90 mol % or less.

5. The inkjet recording medium of claim 1, wherein the difference between the degrees of saponification of the two polyvinyl alcohols having a degree of saponification different from each other is 8 mol % or more.

6. The inkjet recording medium of claim 1, wherein an average degree of polymerization of the low molecular weight polyvinyl alcohol is from 1000 to 2000.

7. The inkjet recording medium of claim 1, wherein a content of each of the two polyvinyl alcohols having a degree of saponification different from each other, with respect to a total amount of the two polyvinyl alcohols included in the ink-receiving layer, is at least 10% by mass.

8. The inkjet recording medium of claim 2, wherein a content of the at least one of the two polyvinyl alcohols having an average degree of polymerization of from 2500 to 4500, with respect to a total amount of polyvinyl alcohols included in the ink-receiving layer, is 50% by mass or more.

* * * * *